United States Patent [19]

Skovgaard

[11] 4,211,267

[45] Jul. 8, 1980

[54] THERMAL INSULATING AND CUSHIONED BAG, ESPECIALLY A CARRYING BAG

[76] Inventor: Leif O. Skovgaard, Jaegumvej 4, Vrogum, DK-6840 Oksbøl, Denmark

[21] Appl. No.: 945,110

[22] Filed: Sep. 25, 1978

[30] Foreign Application Priority Data

Sep. 23, 1977 [DK] Denmark ..... 4212/77

[51] Int. Cl.[2] ..... A61F 7/00; B65D 33/00

[52] U.S. Cl. ..... 150/2.1; 229/55; 229/69; 150/2.2

[58] Field of Search ..... 150/2.1, 2.2; 229/55, 229/62, 3.5 MF, 69

[56] References Cited

U.S. PATENT DOCUMENTS

| | | | |
|---|---|---|---|
| 3,428,103 | 2/1969 | Walsh | 150/2.2 |
| 3,460,740 | 8/1969 | Hagen | 229/69 X |
| 3,834,611 | 9/1974 | Schwarzkopf | 229/55 X |
| 3,868,056 | 2/1975 | Keren | 229/55 |
| 3,948,436 | 4/1976 | Bambara | 229/55 |

*Primary Examiner*—George T. Hall
*Attorney, Agent, or Firm*—Edward F. Levy

[57] ABSTRACT

A thermal insulating and shock absorbant bag, particularly a carrying bag, is formed of walls each having an outer layer of thin, flexible thermoplastic foam of a thickness between the 0.07 mm and 0.14 mm, which provides effective insulating properties. The bag walls each have an inner layer of thin flexible thermoplastic polyethylene film connected by welding to the outer layer at the edge portions of the bag. The inner layer may be formed of two films of polyethylene film with an intermediate film of metal foil located therebetween and steam-connected to one of said polyethylene films. In a preferred embodiment, a flexible insulating layer of padded polyester cotton is disposed between the inner and outer layers to improve the insulating and shock absorbing qualities of the bag. The insulating layer is thermoplastic and is welded to the surrounding layers.

11 Claims, 5 Drawing Figures

THERMAL INSULATING AND CUSHIONED BAG, ESPECIALLY A CARRYING BAG

Figure 1:
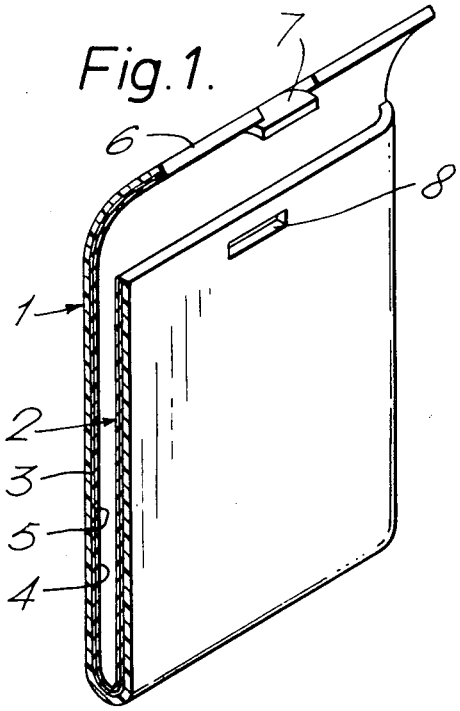

The present invention is a thermal insulating and shock absorbant sort of bag, mainly a carry bag including one or several layers of synthetic film or sheet material.

It is a well-known problem how to get home with frozen food before it thaws, exactly like it is a problem to keep food warm during transport.

Besides the requirements as to the thermal isolating qualities there are also requirements as to easy transportation of the empty bags. The bags must also be so cheap that without hesitation you will buy another bag in case you have forgotten the old one.

Finally it is a requirement that the bag can be used more than once and further the packing must yield a considerable protection of the goods against bumps and blows.

From the description of a German "Offenlegungsschrift" No. 1.807.109 a carry bag of the above described sort is already known. This bag is made of a synthetic material consisting of two synthetic foils which are connected to eachother making air spaces in a regular pattern.

The air spaces have been made by locally pressing one films and covering with the other.

Where the two films are connected either by welding or glueing the bag has neither insulating nor shock absorbing qualities.

As there is a limit as to how close you can make the air spaces in the films there is consequently also a limit to the isolating or shock absorbant qualities of the bag. From the description in U.S. Pat. No. 3,868,056 a kind of bag is known where the bag mentioned in "Offenlegungsschrift" No. 1.807.109 has been improved by sealing the room around the air spaces by fastening a synthetic films to the top of the air spaces.

This bag is thus consisting of an intermediate films with local spaces for forming an air space between the two cover films.

Besides being difficult and expensive to manufacture this bag has the disadvantage that it will lose almost all its isolating and shock absorbant quality at the smallest puncture of the cover films.

The purpose of the present invention is to present a thermic isolating and shock absorbant bag without any deformations of the films to form air spaces and also to prevent a bag which is easy to make.

According to the invention this goal may be reached by one of the films being a flexible, foamy synthetic films. By using a foamy synthetic film you avoid the risk of the bag loosing its thermal insulating and shock absorbant quality.

The foamy synthetic film also gives productional advantages as it is not necessary to form and connect synthetic films to form an isolating air space.

By the foamy synthetic film being weldable you get further productional advantages as the connections are easy made.

The material used for this bag is mainly foamy polyethylene as it is cheap and easy to handle.

It is proved that a foamy polyethylene film, about 0.07–0.14 mm thick, has a relatively fine isolating quality.

Should it be desirable the thermic isolating qualities of the bag may be improved by applying a reflecting metal layer to the foils, preferably aluminum.

In order to protect the metal layer it is steamed on between two polyethylene foils in order to avoid the risk of the metal layer being scraped or rubbed off the film and thus reducing the isolating qualities of the bag.

A carry bag made of an outer foil of 0.07 mm thick, foamy polyethylene and an inner films of above-mentioned sort, consisting of two ordinary polyethylene foils with an intermediate, steamed-on aluminium layer has been proved to be able to keep an article frozen for approximately five hours, which will by most shoppings be sufficient to get home with the frozen goods.

If an even better insulation is desired, the thermal insulating quality of the bag can be improved by placing a flexible, insulating layer between the inner and the outer film which will also improve the shock absorbant quality of the bag. Because of the flexible, insulating layer the bag will remain foldable and thus easy to carry. The bag can easily be folded and carried in a pocket.

Besides being flexible it must be possible to connect the insulating layer to the synthetic film by welding as this gives many productional advantages.

The insulating layer can be a net which is welded on to two cover films so that the meshes of the net form separate insulating air spaces.

Even if the cover film is broken the bag will only locally, and not as a whole, lose its insulating quality.

By using a net you keep the folding qualities of the bag.

The net is mainly made of polyethylene which is cheap and also easy to handle.

So that the packing during transportation, storage and at distribution areas will not take up too much room, insulating materials are used which, when they are relieved from pressure fully or almost will regain their original thickness and thus their insulating quality.

This means that when the bags are piled or bundled the pressure from the upper bags or the pressure applied when bundling the bags, will press the air out of the insulating material, reducing the total thickness of the bags to a minimum.

Mostly an insulating material of a padded structure is used, for instance polyester cotton.

In order to keep the insulating material from collapsing and thereby reducing the total insulating qualities of the bags it is welded on to the synthetic films.

So as not to reduce the insulating qualities the weldings are staggered in order to avoid cold-conductors through the insulation.

The bag is also made so that the insulating space is sealed steamtight from the atmospheric air except from the equalizing opening.

This gives the possibility of pressing the air out of the insulating layer without the risk of reducing the insulating qualities by soaking.

In the following the invention will be described more closely in connection with an explanation of the drawing:

The drawing shows:

FIG. 1: a carry bag with a sectional view of one end.

Figure 2:
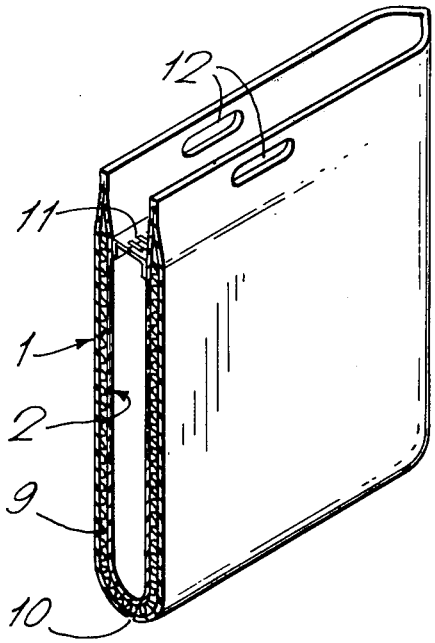
Figure 3:
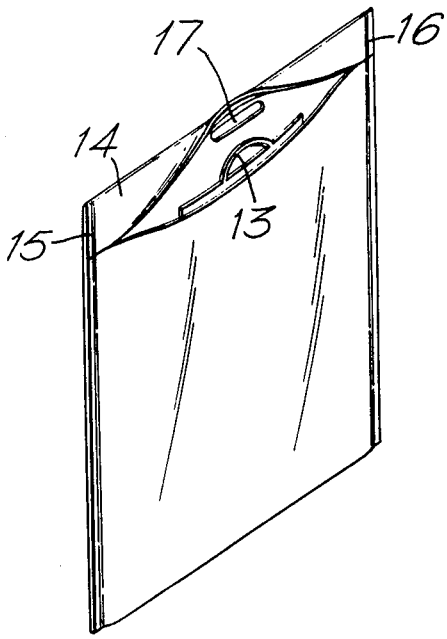
Figure 4:
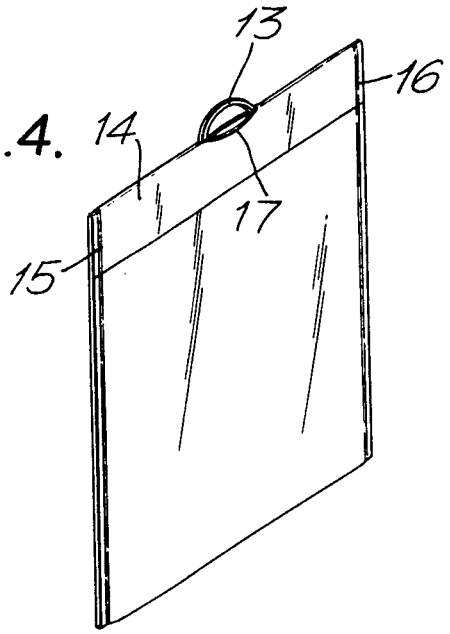

FIG. 2: a carry bag with an insulating layer also giving a sectional view of one end and, FIGS. 3 and 4: a carry bag with a preferred embodiment of the sealing where the bag is shown open in FIG. 3 and closed in FIG. 4.

Figure 5:
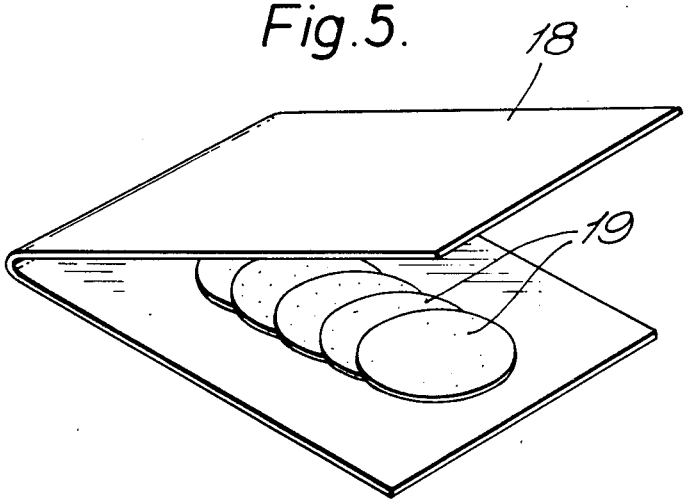

FIG. 5: a bag for meat slices.

The carry bag shown on FIG. 1 consists of two films welded together (1, 2). The outer film (1) is a foamy polyethylene film with a thickness of 0.07–0.14 mm. The inner film consists of three layers, i.e. two ordinary, relatively thin, polyethelene films (3, 4) with an intermediate layer (5) which is steamed on to one of the foils 3 or 4.

The bag is sealed almost hermetically by a flap (6). The flap is fastened by a tongue (7) which can be put through the handle (8) cut out in the bag.

A bag made in the above described way can keep an article frozen for five hours, which will usually be sufficient to get home and place the frozen article in the freezer.

By a development of the bag as per this invention an isolating layer (9) is placed between the two foils (1, 2).

In the embodiment shown in FIG. 2, a padded polyester cotton, weighing 65 g/m$^2$ is used. This material possesses the quality that when the pressure is relieved it will regain its approximate thickness. In the bottom of the bag there is an equalizing opening (10) so that the air in the padded polyester cotton can be pressed out.

When the bags are piled the weight of the upper bags will press the air out of the bags underneath so that the thickness of the packing is reduced to a minimum which is of great importance when storing the packing, especially at the cash registers in the super markets where the room is narrow.

The bag can be closed with a special zipper (11) made almost completely of synthetics so that it can be welded on to the film.

In the bag there is a handle (12) made as ordinary cuttings in the film (1, 2).

The handles can of course be made in many different ways, for instance as carrying handles or as a special handle which can be welded on to the bag.

The preferred execution of the sealing arrangement includes a handle 13 welded on to the inner film (2) and a film 14 over the opening of the foamy outer foil (1). This fold is 14 fastened by welding at the edges 15, 16 of the bag and at the middle of the fold 14 over the bag opening where there is a slight cut 17 for the handle 13.

This execution of the sealing arrangement guarantees the sealing of the bag as the handle 13 must be pulled through the cut 17 in order to carry the bag.

The bag shown on FIG. 5 consists of a single layer 18 of foamy polyethylene film and is mainly used for packing goods in a cold counter.

In the present case the bag is used for packing meat slices 19 with the slices laid on one half of the film which is then folded and welded along its edges.

What is claimed is:

1. A thermal insulating and shock absorbent carrying bag comprising opposed walls each formed of an outer layer and inner layer of thermoplastic sheet material, and an intermediate layer of thermal insulating material disposed between and separating said inner and outer layers, said outer layer comprising a thin, flexible film of thermoplastic polyethylene foam having insulating properties, said inner layer comprising at least one thin flexible sheet of thermoplastic polyethylene film, said intermediate layer comprising a soft, flexible and compressible padding of thermoplastic polyester fibers having high insulating properties, said inner, outer and intermediate layers being joined together by welded seams along the edges of said walls.

2. A carrying bag according to claim 1 in which said outer layer of polyethylene foam has a thickness of between 0.07 and 0.14 mm.

3. A carrying bag according to claim 1 in which said intermediate layer has a thickness greater than the thickness of said inner and outer layers.

4. A carrying bag according to claim 1 in which said intermediate layer of padded polyester fibres has a weight of 65 g/m$^2$.

5. A carrying bag according to claim 1 in which said inner layer includes a sheet of flexible polyethylene film having a coating of thin flexible foil of reflective metal.

6. A carrying bag according to claim 5 in which said metal foil is aluminum foil.

7. A carrying bag according to claim 1 in which said intermediate layer of polyester fibres comprises padded polyester cotton which is compressible and which will regain its original thickness when pressure thereon is relieved.

8. A carrying bag according to claim 1 in which said inner layer comprises two thin flexible sheets of thermoplastic polyethylene film with a sheet of reflective metal foil disposed therebetween and bonded to at least one of said polyethylene sheets.

9. A carrying bag according to claim 8 in which said metal foil is bonded to said polyethylene sheet by steaming.

10. A carrying bag according to claim 1 in which said opposed walls are formed of a continuous length of multi-ply material folded upon itself to provide front and rear wall panels joined at their bottom ends by said fold, the side edges of said front and rear wall panels being joined by a welded seam which also bonds the inner, outer and intermediate layers of said wall panels to each other, the inner, outer and intermediate layers at the top edges of each of said wall panels being separately bonded to each other by welded seams, with said wall panels separated from each other to provide an open top end for said bag.

11. A carrying bag according to claim 10 in which said fold at the bottom end of said bag is provided with an air outlet aperture to permit the escape of air from within said wall panels when said intermediate layer is compressed.

* * * * *